US007694364B1

(12) United States Patent
Toma

(10) Patent No.: US 7,694,364 B1
(45) Date of Patent: Apr. 13, 2010

(54) PLAYPEN BUMPER

(76) Inventor: Dena Toma, 1505 Burwell La., Elcajon, CA (US) 92019

( * ) Notice: Subject to any disclaimer, the term of this patent is extended or adjusted under 35 U.S.C. 154(b) by 0 days.

(21) Appl. No.: 12/157,579

(22) Filed: Jun. 11, 2008

(51) Int. Cl.
*A47C 27/08* (2006.01)

(52) U.S. Cl. ..... 5/424; 5/93.1; 5/946; 446/227

(58) Field of Classification Search ..... 5/946, 5/93.1, 424, 425, 655; 446/227
See application file for complete search history.

(56) References Cited

U.S. PATENT DOCUMENTS

| | | | | |
|---|---|---|---|---|
| 4,800,600 | A | 1/1989 | Baum | |
| 4,890,346 | A | 1/1990 | Rist | |
| 5,241,718 | A | 9/1993 | Pope | |
| 5,410,765 | A | 5/1995 | Youngblood | |
| 5,642,545 | A | 7/1997 | Howard | |
| 6,564,403 | B1 * | 5/2003 | Titus | 5/425 |
| 6,681,421 | B2 * | 1/2004 | Carroll | 5/424 |
| 6,742,751 | B1 | 6/2004 | DeMoor | |

* cited by examiner

*Primary Examiner*—Peter M Cuomo
*Assistant Examiner*—Nicholas Polito
(74) *Attorney, Agent, or Firm*—Norman E. Lehrer

(57) ABSTRACT

A playpen bumper includes an elongated strip of generally soft material having a first surface, a second surface, and ties for releasably fastening the strip of material to a playpen. The strip of material has padding secured between the first and second surfaces. The first surface includes various ways for releasably securing a plurality of toys thereto such as a band or a pocket. The fastening means is attached to the second surface of the strip of material and is used to releasably fasten the bumper to the playpen. The first surface faces the interior or confined space of the playpen formed by a plurality of side walls and a bottom wall. The second surface faces outwardly from the confined space.

2 Claims, 3 Drawing Sheets

FIG. 1
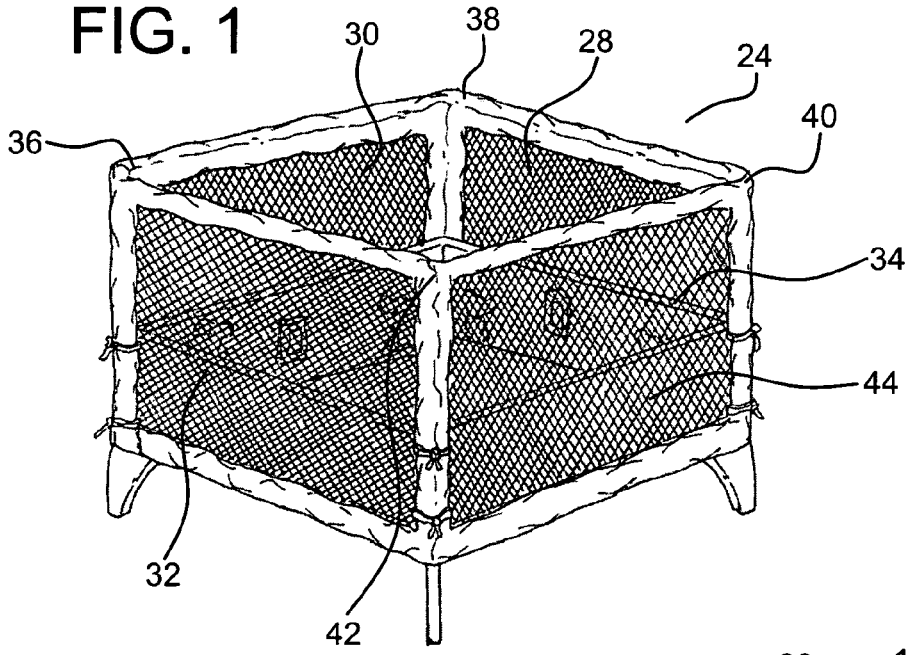
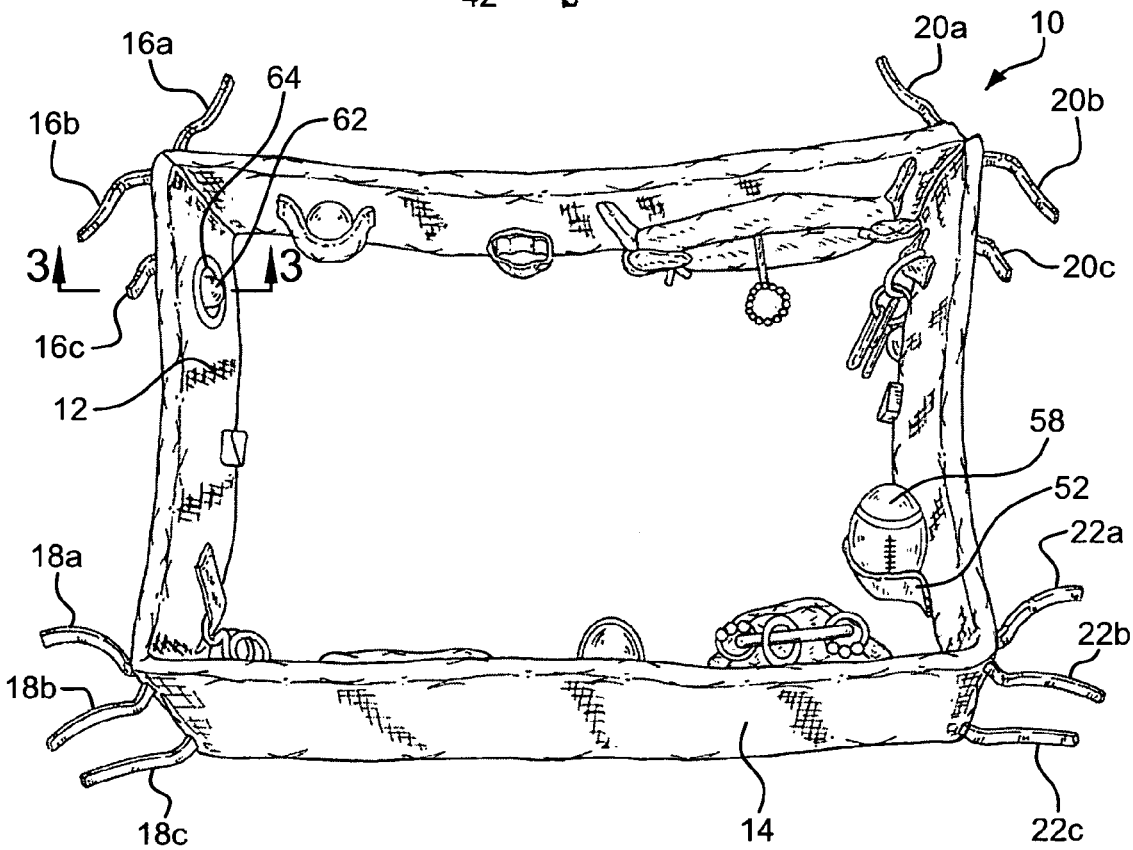
FIG. 2

FIG. 3
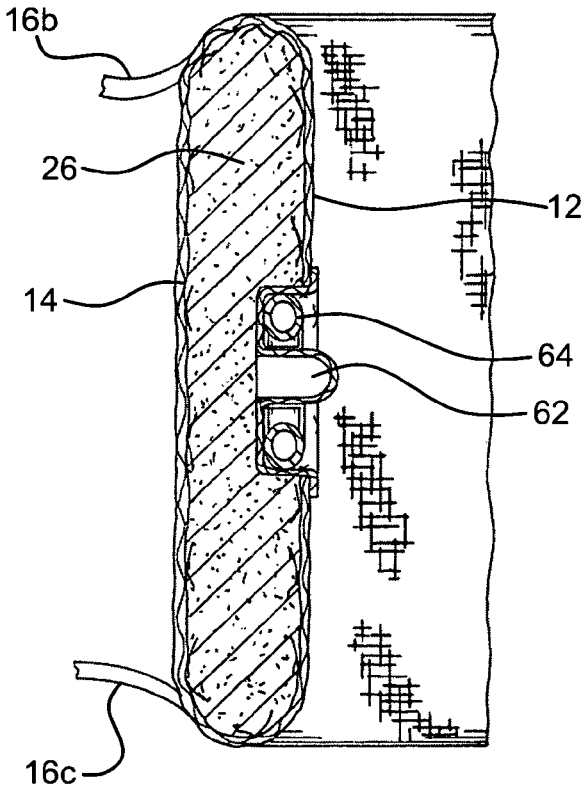
FIG. 5
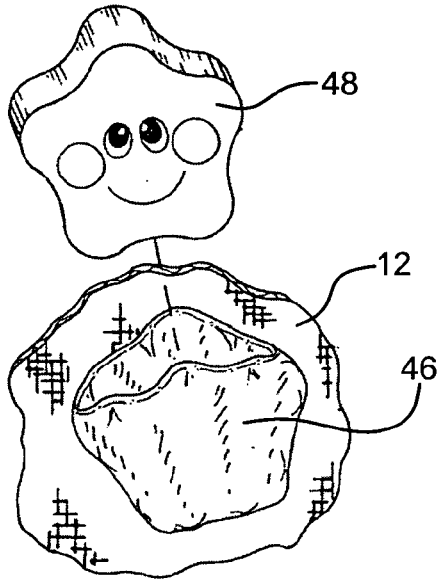
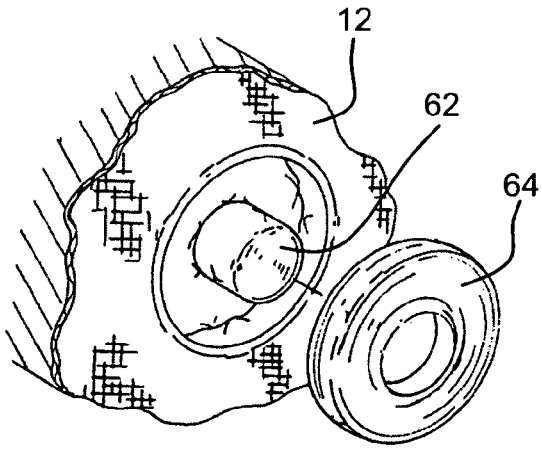
FIG. 4
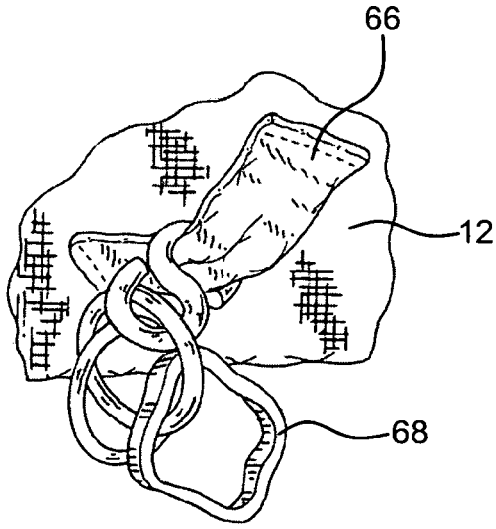
FIG. 6

FIG. 7
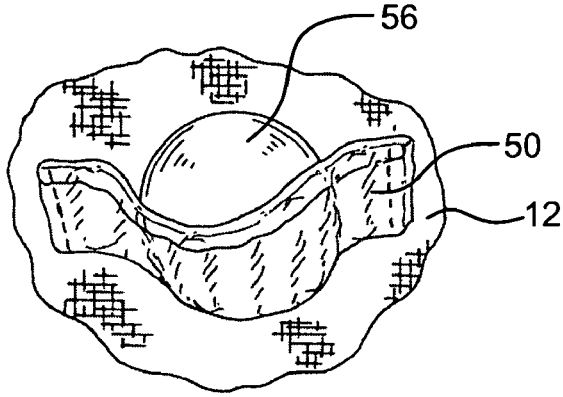
FIG. 8
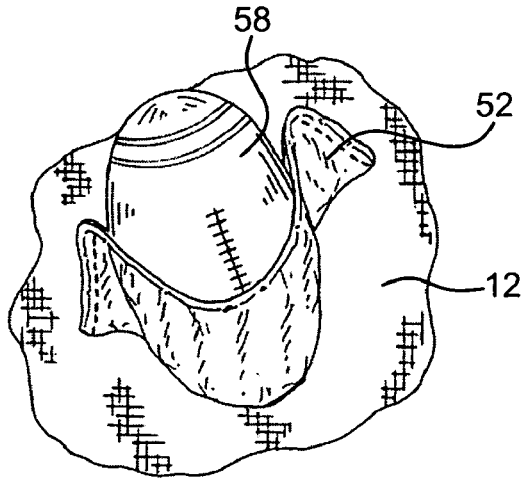
FIG. 9
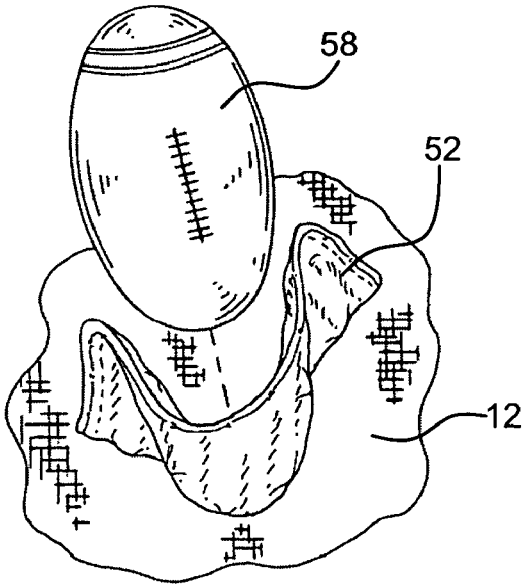
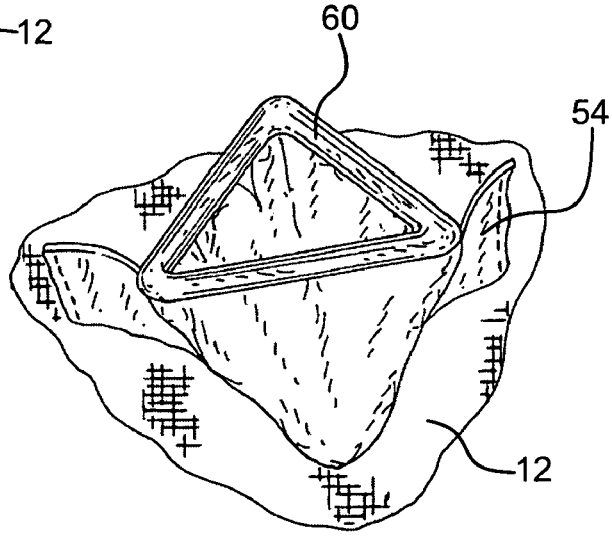
FIG. 10

PLAYPEN BUMPER

BACKGROUND OF THE INVENTION

The present invention is directed toward a bumper for an infant or child's playpen or the like and more particularly, toward a unique bumper that protects and provides entertainment for a child.

Crib bumpers are well known and are used to protect a child from injury while in the crib. The bumpers are typically soft and may be decorative or include various amusement devices such as toys, music, or mirrors in order to entertain the child while he or she is in the crib. For example, U.S. Pat. No. 4,800,600 to Baum discloses a decorative crib bumper. U.S. Pat. No. 6,681,421 to Carroll discloses a crib bumper with a picture display. Also, U.S. Pat. No. 4,890,324 to Rist discloses a soft bumper for a crib that includes a pocket stitched to the interior face of the bumper. An audio device may be placed within the pocket so that the child is soothed. However, none of these patents discloses a bumper for a playpen nor do any disclose the concept of securing toys to a bumper for a playpen.

U.S. Pat. No. 5,642,545 to Howard discloses a crib bumper and a pocket attached to the bumper for holding various items such as toys, baby wipes, and pacifiers. However, the pocket is located outside of the crib so that the child would be unable to reach for any toys held within the pocket while in the playpen.

Therefore, a need exists for a bumper that may be used with a playpen and protects a child but also includes toys that may be easily accessible to a child while in the playpen.

SUMMARY OF THE INVENTION

The present invention is designed to overcome the deficiencies of the prior art discussed above. It is an object of the present invention to provide a playpen bumper that offers protection for a child.

It is another object of the present invention to provide a playpen bumper that entertains a child.

In accordance with the illustrative embodiments demonstrating features and advantages of the present invention, there is provided a bumper for a playpen that includes an elongated strip of generally soft material having a first surface, a second surface, and means for releasably fastening the strip of material to a playpen. The strip of material has padding secured between the first and second surfaces. The first surface includes means for releasably securing a plurality of toys thereto. The fastening means is attached to the second surface of the strip of material and is used to releasably fasten the bumper to the playpen. The first surface faces the interior or confined space of the playpen formed by a plurality of side walls and a bottom wall. The second surface faces outwardly from the confined space.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

FIG. 1 illustrates the bumper of the present invention being used on a playpen;

FIG. 2 is a top perspective view of the bumper of the present invention;

FIG. 3 is a cross-sectional view taken though line 3-3 of FIG. 2;

FIG. 4 is an exploded view of a toy releasably secured to the bumper of the present invention;

FIG. 5 is an exploded view of another toy releasably secured to the bumper of the present invention;

FIG. 6 is a front perspective view of a third toy found on the bumper of the present invention;

FIG. 7 illustrates a fourth toy releasably secured to the bumper of the present invention;

FIG. 8 illustrates a fifth toy releasably secured to the bumper of the present invention;

FIG. 9 is an exploded view of the toy illustrated in FIG. 8; and

FIG. 10 illustrates a sixth toy releasably secured to the bumper of the present invention.

DETAILED DESCRIPTION OF THE PREFERRED EMBODIMENT

Referring now to the drawings in detail wherein like reference numerals have been used throughout the various figures to designate like elements, there is shown in FIG. 2 a playpen bumper constructed in accordance with the principles of the present invention and designated generally as 10.

The playpen bumper of the present invention essentially includes an elongated strip of generally soft material having a first surface 12, a second surface 14, and means 16*a*-16*c*, 18*a*-18*c*, 20*a*-20*c*, and 22*a*-22*c*, for example, for releasably fastening the strip of material to a playpen 24. (See FIG. 2.) The strip of material has padding 26 secured between the first and second surfaces 12 and 14, respectively. (See FIG. 3.) As will be described in more detail below, the first surface 12 includes a plurality of different means for releasably securing a plurality of toys thereto.

The fastening means 16*a*-16*c*, 18*a*-18*c*, 20*a*-20*c*, and 22*a*-22*c* are attached to the second surface 14 of the strip of material. The elongated strip of material is adapted to be placed within a playpen and releasably fastened thereto. The material may be made from a cloth, fabric, or like material. The material should be soft and with the padding, protect a child while in the playpen from bumping a side wall or corner or otherwise causing injury to him or herself. The padding may be made from foam, batting, or the like.

The first surface 12 faces the interior or confined space of the playpen 24 formed by a plurality of side walls 28, 30, 32, and 34, corner supports 36, 38, 40, and 42, and a bottom wall 44. The second surface 14 faces outwardly from the confined space. The fastening means 16*a*-16*c*, 18*a*-18*c*, 20*a*-20*c*, and 22*a*-22*c* include a plurality of fabric ties or the like in order to releasably yet securely fasten the bumper to the corner supports of the playpen. (See FIG. 1.) The bumper may be easily removed, cleaned, and replaced as desired.

In the embodiment shown, the fastening means 16*a*-16*c*, 18*a*-18*c*, 20*a*-20*c*, and 22*a*-22*c* pass through the openings in the mesh material forming the walls of the playpen 24. If the mesh openings are not large enough, it may be necessary to enlarge the holes or form appropriately sized holes. When this is done, it may be desirable to use grommets around the holes to prevent them from ripping.

The securing means includes various different types of means for releasably securing a variety of toys to the first surface 12. For example, the securing means may be a pocket 46 into which a toy 48 may be received and removed therefrom. (See FIG. 5.) Other examples of pockets are shown in FIGS. 7-10. These pockets 50, 52, and 54 respectively may house a round ball 56, a football 58, and a triangle 60.

Alternatively, the securing means may also be a projection 62 extending outwardly from the first surface 12 where a toy in the form of a ring 64 may be releasably secured to the projection 62 by simply slipping the ring over the projection. (See FIGS. 3 and 4.) The projection 62 is attached to a base member where the base member is secured to the first surface 12. (See FIG. 3.) An annular rim surrounds the projection 62 and the toy 64 fits between the projection 62 and the rim. (See FIG. 4.) Also, the securing means may be a band 66 of material adapted to suspend a toy 68 therefrom. (See FIG. 6.) All of the securing means are permanently sewn or otherwise adhered to the first surface. All of the toys are made from a biocompatible material and may be rigid or soft and may take on various forms.

The present invention may be embodied in other specific forms without departing from the spirit and essential attributes thereof and accordingly, reference should be made to the appended claims rather than to the foregoing specification as indicating the scope of the invention.

I claim:

1. A bumper for a playpen having a plurality of side walls and a bottom wall forming a confined space for a child comprising:

an elongated strip of generally soft material having a first surface adapted to face the confined space of the playpen and a second surface adapted to face outwardly from the confined space, said strip of material having padding secured between said first and second surfaces, said first surface including means for releasably securing a plurality of toys to said first surface and means for releasably fastening said strip of material to the playpen, said fastening means being attached to said second surface of said strip of material wherein said elongated strip of material is adapted to be placed within a playpen and releasably secured thereto and said securing means includes a pocket attached to said interior facing surface, a band of material adapted to suspend a toy therefrom, and a projection attached to a base member, said base member being secured to said first surface, said projection extending away from said first surface, an annular rim surrounding said projection and a toy with an opening therein adapted to fit between said projection and said rim.

2. The playpen bumper of claim 1 wherein said fastening means includes fabric ties.

* * * * *